United States Patent [19]

Janssen et al.

[11] 4,155,140

[45] May 22, 1979

[54] PAINT APPLICATOR HAVING DETACHABLE HANDLE

[75] Inventors: Robert I. Janssen, St. Paul; Donald R. Cooke, Minneapolis, both of Minn.

[73] Assignee: Padco, Inc., Minneapolis, Minn.

[21] Appl. No.: 906,927

[22] Filed: May 18, 1978

[51] Int. Cl.[2] ..... B05C 17/00; B25G 3/18

[52] U.S. Cl. ..... 15/210 R; 15/145

[58] Field of Search ..... 15/145, 176, 210 R; 16/114 R, 114 A; 403/331

[56] References Cited

U.S. PATENT DOCUMENTS

| | | | |
|---|---|---|---|
| 361,393 | 4/1887 | Bigelow | 15/145 |
| 1,767,349 | 6/1930 | Cross | 15/143 R |
| 3,359,589 | 12/1967 | Moore | 15/210 R |
| 3,720,976 | 3/1973 | Bailey | 15/144 A |
| 4,127,911 | 12/1978 | Cupp | 15/210 R |

FOREIGN PATENT DOCUMENTS

| | | | |
|---|---|---|---|
| 868454 | 4/1971 | Canada | 15/176 |
| 1427149 | 2/1976 | United Kingdom | 15/210 R |

*Primary Examiner*—Daniel Blum

*Attorney, Agent, or Firm*—Kinney, Lange, Westman and Fairbairn

[57] ABSTRACT

A paint applicator has a handle and a pad supporting base. A paint applying pad is attached to a first face of the base. First and second flanges, a groove, and a ramp are provided on a second face of the base for receiving and holding the handle. The handle includes a plate with side walls and a lip extending below a front edge of the plate, and a gripping portion. To assemble the paint applicator, the plate is inserted into and slid rearwardly in the first and second flanges. The lip is guided up the ramp and into the groove, where the plate is held in a locking position by the first and second flanges engaging the side walls and the groove, where the plate is held in a locking position by the first and second flanges engaging the side walls and the groove engaging the lip. The gripping portion of the handle is inclined at an angle with respect to the plate to facilitate easy assembly and disassembly of the applicator, as well as to provide an advantageous angle at which to hold the applicator when applying paint to a surface.

7 Claims, 11 Drawing Figures

PAINT APPLICATOR HAVING DETACHABLE HANDLE

BACKGROUND OF THE INVENTION

The present invention relates to the connection of a handle to a pad supporting base. In particular, the present invention is an advantageous paint applicator having a pad supporting base and a handle which may be easily connected and disconnected.

In the past, there have been many devices which have been used to releasably connect a handle with a base, which in turn has a pad attached to it. These devices have found use in various types of cleaning devices, and in painting devices in which a handle is used with interchangeable paint pads. Examples of prior art devices include the following patents: Knarnes U.S. Pat. No. 2,712,145; Horowitz U.S. Pat. No. 2,938,223; Bell et al. U.S. Pat. No. 3,105,989; Baicker U.S. Pat. No. 3,113,335; Callaghan U.S. Pat. No. 3,369,474; Burns et al. U.S. Pat. No. 3,473,183; Chase et al. U.S. Pat. No. 3,717,896; Bailey U.S. Pat. No. 3,720,976; Jerry U.S. Pat. No. 3,775,017; Alverez U.S. Pat. No. 3,790,232; Numbers et al. U.S. Pat. No. 3,820,187; Kroll U.S. Pat. No. 3,947,915; and McCalla U.S. Pat. No. 4,033,010.

There is, however, a continuing need for improved devices having detachable handles and bases. This is particularly true in the case of paint applicators. These devices must be easy to assemble, use, and disassemble, should reliably lock the handle and base together during use, and should have low manufacturing cost.

SUMMARY OF THE INVENTION

The present invention is an improved handle/base assembly. The handle has a plate and a gripping portion. The plate has side walls and a lip extending below a first edge of the plate.

The base has first and second faces, with the first face supporting or being connected to a pad, and the second face being adapted for attachment to the handle. First and second flanges are provided on the second face for slidably receiving and holding the plate at the side walls. A groove is provided in the second face for receiving and holding the lip when the handle and base are in a locking position. The groove is positioned proximate one end of the first and second flanges and is oriented transverse to the first and second flanges. A ramp is also provided in the second face which slopes from a first edge of the base to the groove. The ramp engages the lip and guides the lip to the groove as the plate is slid into the locking position. In this locking position, the side walls are held by the first and second flanges, and the lip is held in the groove.

DETAILED DESCRIPTION OF THE PREFERRED EMBODIMENTS

Figure 1:
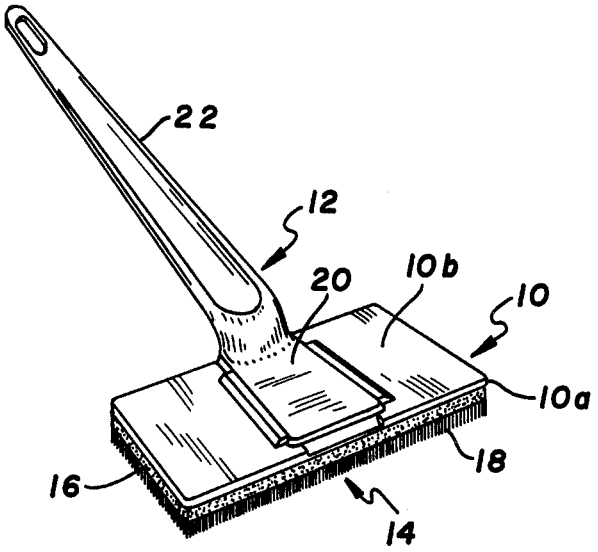
FIG. 1 is a perspective view of a paint applicator using a preferred embodiment of the present invention.

FIG. 1 shows a preferred embodiment of the paint applicator of the present invention, which includes a pad supporting base 10 and a handle 12. Base 10 has a first face 10*a*, to which a paint applying pad 14 is attached. In a preferred embodiment, paint applying pad 14 includes a layer 16 of a foam material attached directly to face 10*a* and a layer 18 of bristles attached to foam layer 16.

Handle 12 includes a plate 20 and a gripping portion 22. When handle 12 and base 10 are in their locking position, as shown in FIG. 1, the device may be used as a paint applicator by dipping pad 14 into paint, and then applying the paint to a surface to be painted. The user grasps handle 12 at the gripping portion 22.

Figure 2:
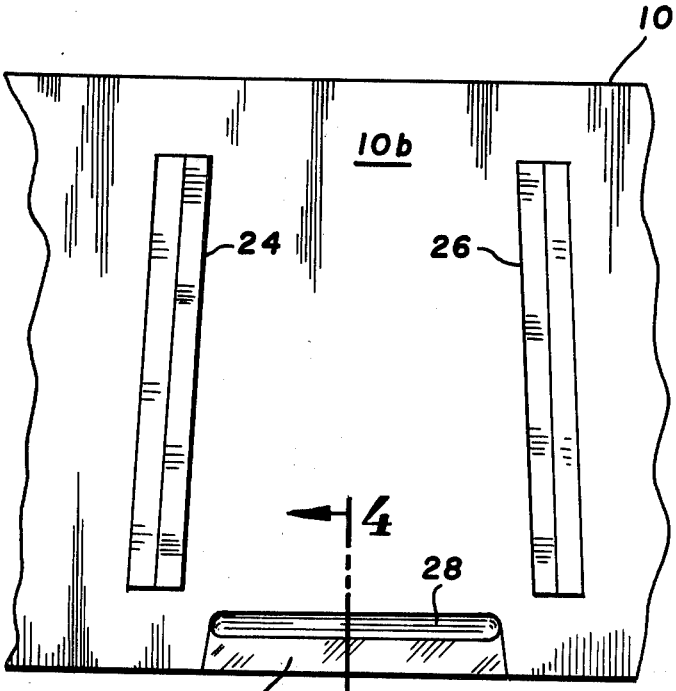
FIG. 2 is a top view of the base of the paint applicator.
Figure 4:
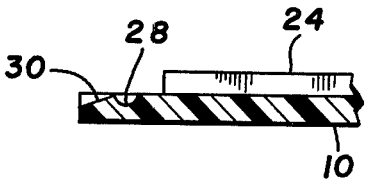
FIG. 4 is a sectional view of a portion of the base along line 4—4 of FIG. 2.
Figure 3:
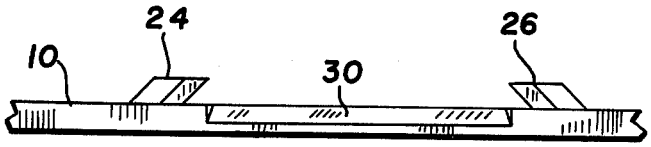
FIG. 3 is a front view of the base.
Figure 5:
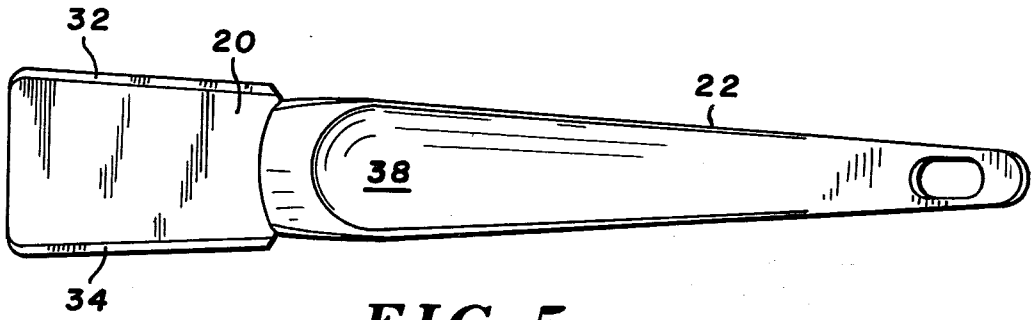
FIG. 5 is a top view of the handle.
Figure 6:
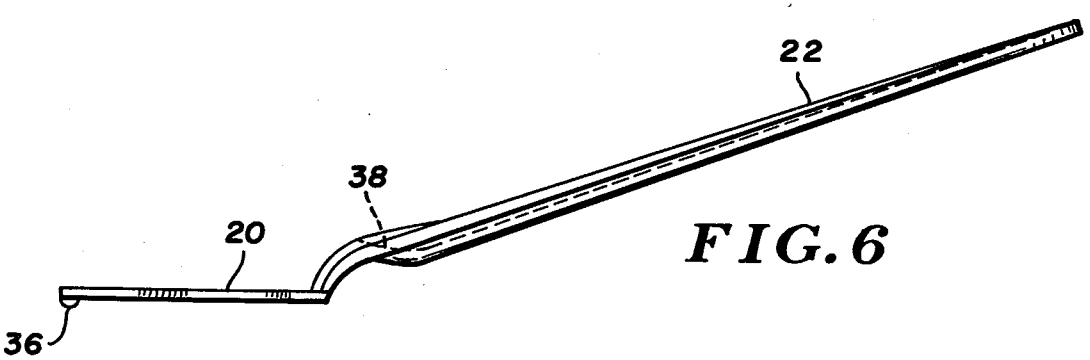
FIG. 6 is a side view of the handle.
Figure 8:
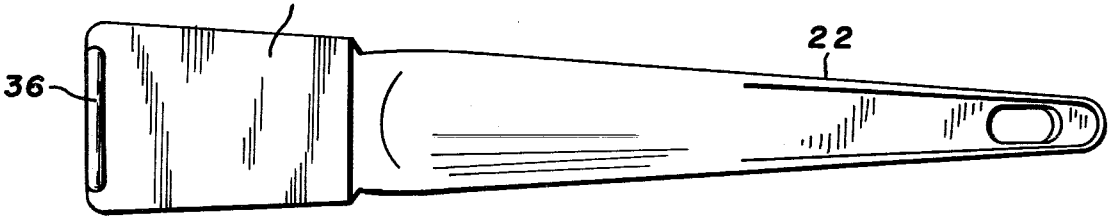
FIG. 8 is a bottom view of the handle.
Figure 7:
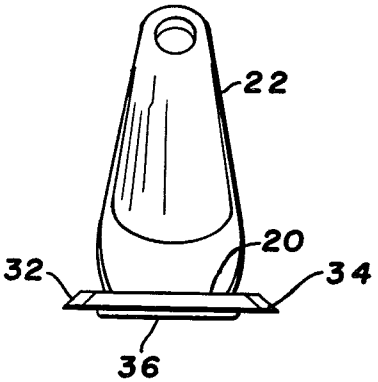
FIG. 7 is a front view of the handle.

FIGS. 2 through 4 show base 10 in further detail. As shown in FIGS. 2 through 4, base 10 includes two inclined flanges 24 and 26 which receive plate 20. As shown in FIGS. 2 and 3, flanges 24 and 26 are inclined and slightly converge toward the rear of base 10. This permits plate 20 to slide into slides 24 and 26 in only one direction (i.e. from the front of base 10). Base 10 also includes a transverse groove 28 (which is positioned near the front end of flanges 24 and 26) and a ramp 30 (which slopes upward from the front edge of base 10 to groove 28). Groove 28 and ramp 30 assist in releasably holding plate 20 in position, while permitting easy insertion and removal of plate 20.

In one preferred embodiment, base 10 is molded plastic with a thickness of about 0.080 inches. Flanges 24 and 26 are inclined at approximately 45°, and are spaced approximately 1.250 inches at their front ends, and approximately 1.125 inches at their rear ends. Groove 28 has a length of about 0.936 inches long, a width of about 0.080 inches, a depth of about 0.040 inches, and is positioned about 0.156 inches from the front edge of base 10. The front edge of ramp 30 is about 0.040 inches below second face 10*b* and slopes upward to its rear edge (immediately in front of groove 28) which is coplanar with second face 10*b*.

FIGS. 5 through 8 show handle 12 in greater detail. As shown in the Figures, plate 20 has inclined side walls 32 and 34 which, like slides 24 and 26, converge slightly toward the rear. The width of plate 12 is selected so that it may slide easily into and out of flanges 24 and 26. Due to the converging of both side walls 32 and 34 and flanges 24 and 26, plate 20 may only be inserted and removed from flanges 24 and 26 from the front of base 10.

Plate 20 also includes a downturned lip or lock lug 36 on the bottom of plate 20 at or near the front edge of plate 20. Lip 36 engages ramp 30 and then groove 28 as plate 20 is inserted into flanges 24 and 26. Lip 36 is rounded so that it can easily snap into and out of groove 28 when sufficient force is supplied between base 10 and handle 12, but is large and deep enough that it securely holds handle 12 with respect to base 10 under normal operating conditions.

As shown in the Figures, gripping portion 22 is preferably attached to plate 20 near the rear end of plate 20 and is oriented at an inclined angle with respect to plate 20. This inclination of the gripping portion makes it easier to snap and slide the handle 12 and base 10 together without interference between base 10 and the person's hand gripping handle 12. In addition, the inclined orientation of gripping portion 22 provides a better angle at which to hold the paint applicator when applying paint to a surface.

In the preferred embodiment shown in the Figures, gripping portion 22 includes a recess 38 near its front end. This recess receives the thumb of the user and enables the handle to be securely gripped not only for painting, but also when connecting and disconnecting handle 12 and base 10.

In the preferred embodiment discussed previously, handle 12 is also formed of molded plastic. The overall length of handle 12 is about 6.500 inches. Plate 20 has a length of about 1.6875 inches, a thickness of about 0.080 inches, a width at the front end of about 1.250 inches, and a width at the rear end of about 1.125 inches. Side walls 32 and 34 are sloped at approximately 45°. Lip 36 has a radius of about 0.03125 inches and a length of about 0.875 inches, so that lip 36 is slightly smaller than groove 28 in all dimensions.

Figure 9:
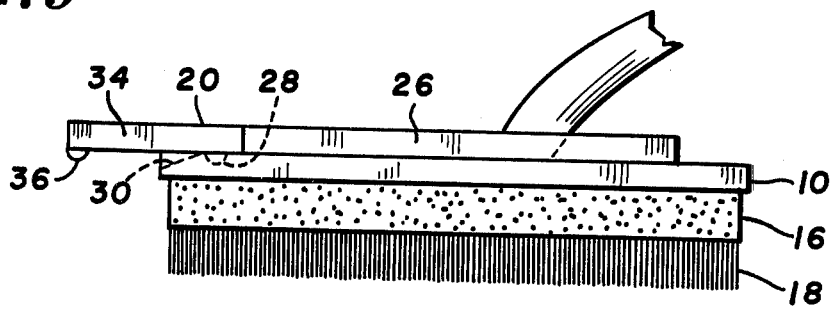
FIGS. 9, 10, and 11 are side views of the handle and base as the handle is slid into locking position.
Figure 10:
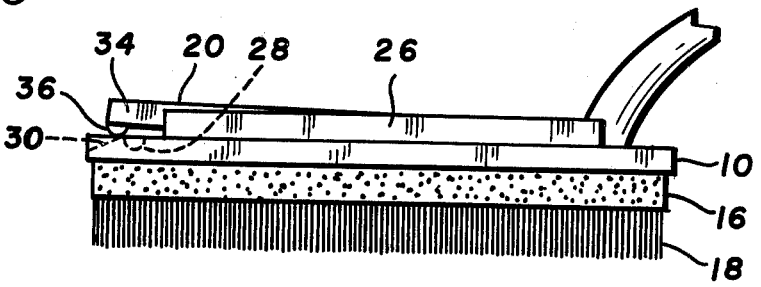
Figure 11:
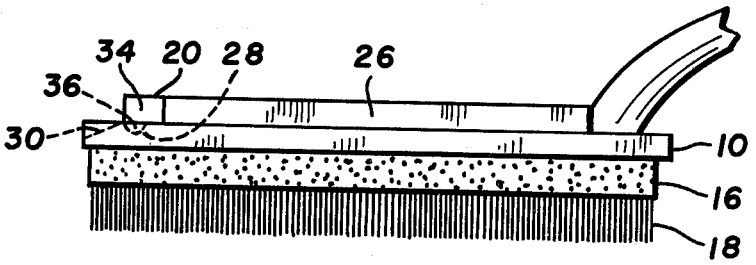

FIGS. 9, 10, and 11 show side views of base 10 and handle 12 as handle 12 is slid into the locking position. In FIG. 9, plate 20 has been inserted between flanges 24 and 26, and plate 20 is beginning to be slid rearwardly with respect to base 10. In the position shown in FIG. 9, lip 36 has not yet engaged ramp 30.

In FIG. 10, plate 12 has been pulled further backward and lip 36 has moved upward along ramp 30. As shown in FIG. 10, ramp 30 raises lip 36 and therefore the front end of plate 20 as handle 12 is pulled back toward the locking position.

Just as side walls 32 and 34 firmly engage flanges 24 and 26, lip 36 passes the top of ramp 30 and snaps into groove 28, as shown in FIG. 11. This provides a very secure lock for handle 12. Engagement of lip 36 in groove 28 holds handle 12 in a position in which side walls 32 and 34 snugly engage flanges 24 and 26. This locking position is secure for normal use, and handle 12 cannot be removed from base 10 unless sufficient force is applied between base 10 and handle 12 to move handle 12 forward with respect to base 10 and pop lip 36 out of groove 28. While this is simple to do when disassembly is desired, under normal use the forces on the applicator are not sufficient to separate base 10 and handle 12.

In conclusion, the present invention is a highly advantageous handle/base assembly which may be advantageously used for paint applicators, as well as for other devices having a pad supporting base, such as cleaning devices. The present invention is easy to assemble, to use, and to disassemble. During normal use, the handle and base are reliably locked together so that the two parts will not accidentally separate. Finally, the device is capable of very low manufacturing cost, since it is far less complex and can, preferably, be formed from molded plastic.

Although the present invention has been described with reference to preferred embodiments, workers skilled in the art will recognize that changes may be made in form and detail without departing from the spirit and scope of the invention. For example, the gripping portion 22 of handle 12 could be attached at the opposite end of plate 20, and extend in the opposite direction from that shown in the Figures. In that case, lip 36 would be considered to be near the rear rather than the front edge of plate 20, and groove 28 and ramp 30 would be considered to be near the rear rather than the front edge of base 10.

What is claimed is:

1. A device for treating a surface with a pad having a material treating surface, the device comprising:

a handle having a plate and a gripping portion, the plate having side walls and a lip extending below a first edge of the plate;

a pad supporting base having first and second faces, the first face for supporting the pad, and the second face for attachment to the handle;

first and second opposed flanges connected to the second face for slidably receiving and holding the plate at the side walls;

a groove in the second face positioned proximate one end of the first and second flanges and transverse to the first and second flanges for receiving and holding the lip; and a ramp in the second face rising from a first edge of the base to the groove for engaging the lip and guiding the lip to the groove as the plate is slid and snapped into a locking position in which the side walls are held by the first and second flanges and the lip is held in the groove.

2. The device of claim 1 wherein the gripping portion of the handle is inclined at an angle with respect to the plate.

3. The device of claim 2 wherein the gripping portion includes a thumb receiving recess positioned in the gripping portion at an end proximate the plate.

4. The device of claim 1 wherein the side walls of the plate are sloped, and wherein the first and second flanges are sloped to receive and hold the sloped side walls.

5. The device of claim 1 wherein the side walls of the plate converge toward the rear of the plate, and wherein the first and second flanges converge toward the rear of the pad supporting base.

6. The device of claim 1 or 5 wherein the first edge of the base is the front edge of the base.

7. The device of claim 6 wherein the first edge of the plate is the front edge of the plate.

* * * * *